US005603125A

United States Patent [19]

Chou

[11] Patent Number: 5,603,125

[45] Date of Patent: Feb. 18, 1997

[54] SWIMMING GOGGLES AND MANUFACTURING METHOD THEREFOR

[76] Inventor: Terry Chou, No. 12, Hsin Ho Heng Rd., Tainan City, Taiwan

[21] Appl. No.: 633,165

[22] Filed: Apr. 16, 1996

[51] Int. Cl.[6] ..... A61F 9/02

[52] U.S. Cl. ..... 2/428; 351/178

[58] Field of Search ..... 2/428, 429, 430, 2/426, 441, 443, 439, 440, 442; 351/178; 359/819

[56] References Cited

U.S. PATENT DOCUMENTS

| | | | |
|---|---|---|---|
| 2,388,205 | 10/1945 | Bernheim et al. | 2/441 |
| 2,388,680 | 4/1970 | Ring | 2/441 X |
| 4,087,865 | 5/1978 | Garofalo | 2/428 |
| 5,046,198 | 9/1991 | Hunnebeck | 2/441 X |
| 5,526,068 | 6/1996 | Markovitz | 351/178 X |

*Primary Examiner*—Peter Nerbun

*Attorney, Agent, or Firm*—Morton J. Rosenberg; David I. Klein

[57] ABSTRACT

A pair of swimming goggles includes a frame made of plastic material and including a pair of rims each defining an engaging groove therein. Each of the rims includes an annular member extending inwardly from an inner periphery which defines the engaging groove and thus separating the engaging groove into an outer portion and an inner portion. A lens of rigid transparent material is received in the outer portion of each of the rims and has a first engaging member formed on a first side thereof. An engaging ring of rigid material is mounted in the inner portion of each of the rims and has a second engaging member on a first side thereof, in which one of each of the first engaging members and the second engaging members extends through the associated annular member to engage with one another. The lenses, the frame, and the engaging rings are fused together by ultrasonic waves, thereby forming an integral pair of swimming goggles.

16 Claims, 8 Drawing Sheets

SWIMMING GOGGLES AND MANUFACTURING METHOD THEREFOR

BACKGROUND OF THE INVENTION

1. Field of the Invention

The present invention relates to swimming goggles and a manufacturing method therefor, and more particularly to a pair of swimming goggles having a reinforced binding effect, improved waterproof effect, water-guiding effect, and providing a good vision.

2. Description of the Related Art

Swimming goggles are a commonly used article in pools. FIG. 7 of the drawings illustrates a typical pair of swimming goggles which includes a frame 53 made of plastic material and having a pair of rims 51 each having an engaging groove 511 defined therein, a strap 52 interconnecting the rims 51, and a pair of lenses 50 which are made of transparent rigid material and each of which is mounted in the engaging groove 511 of an associated rim 51. As shown in FIG. 7, each lens 50 includes a flange 501 formed along an outer periphery thereof so as to be fittingly received in the engaging groove 511 of the associated rim 51. Each rim 51 includes an eye socket-contacting member 512 formed along a periphery thereof and made of flexible material so as to provide smooth, comfortable contact to an eye socket of the user.

Assembly of the above swimming goggles is labor-intensive as it requires a worker to stretch each of the rims 51, thereby allowing the flange 501 of an associated lens 50 to be received in the engaging groove 511. A potential problem of the swimming goggles so assembled is that flexibility of the rims 51 may be reduced due to the stretching procedure during assembly such that a waterproof engagement between the lens 50 and the associated rim 51 cannot be obtained.

FIG. 8 illustrates an improved method according to prior art, the method including firstly punching and cutting a rigid transparent sheet (not shown) to form lenses of the required shape (step 60) and, secondly, integrally forming the lenses and a frame for receiving the lenses (see step 61). Still referring to FIG. 8 and further to FIG. 9, the rigid transparent sheet is placed on a punching machine (not shown) and is punched by a mold (not shown) having a contour complimentary to that of the lenses, thereby forming the required lenses 70 after cutting. The lenses 70 are then placed in an injection mold (not shown) which is then injected with plastic material to form the required swimming goggles. A periphery of each lens 70 is enclosed by and joined to a lip 711 of an associated rim 71 formed by the mold injection, thereby securely fixing the lenses 70 in the rims 71.

Although the improved method of prior art may save time for manufacturing, it still has some drawbacks as follows: (1) the lips 711 result in a reduction in a field of vision by an angle "a"; (2) a front surface of each of the lens 70 is lower than a peripheral end edge of the associated rim 71 such that water may accumulate in a joining area represented by "b", rendering a restricted vision of the user in the water; (3) the rims 70 are made of rigid material while the lens frames 51 are made of plastic material, these two different materials cannot be fused and joined perfectly, and sometimes are very difficult to achieve the purpose of fusion and joining.

The present invention is intended to provide an improved method to mitigate and/or obviate the above drawbacks.

SUMMARY OF THE INVENTION

A method for manufacturing swimming goggles in accordance with the present invention includes the steps of:

(a) respectively forming a pair of lenses of a transparent first rigid material and a frame of plastic material, the frame comprising a pair of rims each defining an engaging groove therein, each of the rims comprising an annular member extending inwardly from an inner periphery which defines the engaging groove and thus separating the engaging groove into an outer portion for receiving the lens and an inner portion, each of the lenses having a first engaging member formed on a first side thereof;

(b) forming a pair of engaging rings of a second rigid material, each of the engaging rings having a second engaging member formed on a first side thereof and being mounted in the inner portion of the associated rim, wherein one of each of the first engaging members and the second engaging members extends through the associated annular member to engage with the other; and (c) fusing the lenses, the frame, and the engaging rings together by ultrasonic waves, thereby forming an integral pair of swimming goggles.

Accordingly, a pair of swimming goggles made by the method in accordance with the present invention includes:

a frame of plastic material and comprising a pair of rims each defining an engaging groove therein, each of the rims comprising an annular member extending inwardly from an inner periphery which defines the engaging groove and thus separating the engaging groove into an outer portion and an inner portion;

a pair of lenses of a transparent first rigid material and each being received in the outer portion of the associated rim and having a first engaging member formed on a first side thereof; and a pair of engaging rings of a second rigid material and each having a second engaging member on a first side thereof and being mounted in the inner portion of the associated rim, one of each of the first engaging members and the second engaging members extending through the associated annular member to engage with the other.

The lenses, the frame, and the engaging rings being fused together by ultrasonic waves, thereby forming an integral pair of swimming goggles.

In accordance with one aspect of the invention, the first engaging member of each of the lenses includes a plurality of recesses defined along a periphery of the first side thereof, and the second engaging member of each of the engaging rings includes a plurality of protrusions formed along a periphery of the first side thereof, and the annular member includes a plurality of annularly disposed holes through which an associated protrusion of the engaging ring extends to be received in the associated recess of the lens.

In accordance with a further aspect of the invention, the first engaging member of each of the lenses includes a plurality of protrusions defined along a periphery of the first side thereof, and the second engaging member of each of the engaging rings includes a plurality of recesses formed along a periphery of the first side thereof, and the annular member includes a plurality of annularly disposed holes through which an associated protrusion of the lens extends to be received in the associated recess of the engaging ring.

Preferably, each of the protrusions has a distal end for engaging with a conic peripheral surface which defines each of the recesses, preferably, the engaging rings and the lenses are of the same material such that a reliable waterproof engaging effect between the protrusions and the recesses is provided and that the lenses are reliably fixedly received in the rims.

In accordance with another aspect of the invention, the first engaging member of the lens includes a plurality of protrusions formed on the first side thereof, while the first side of the engaging ring is flat. In accordance with still another aspect of the invention, the first engaging member of the lens includes an annular groove defined in the first side thereof, while the second engaging member of the engaging ring includes annular protrusion formed on the first side thereof.

In a preferred embodiment, each lens includes a first annular ridge extending along a peripheral edge of the first side thereof, while each engaging ring includes a second annular ridge extending along a peripheral edge of the first side thereof. The first and second annular ridges respectively and tightly bear against two sides of the annular member of plastic material, thereby assuring a waterproof engagement.

Other objects, advantages, and novel features of the invention will become more apparent from the following detailed description when taken in conjunction with the accompanying drawings.

DESCRIPTION OF THE PREFERRED EMBODIMENTS

Figure 1:
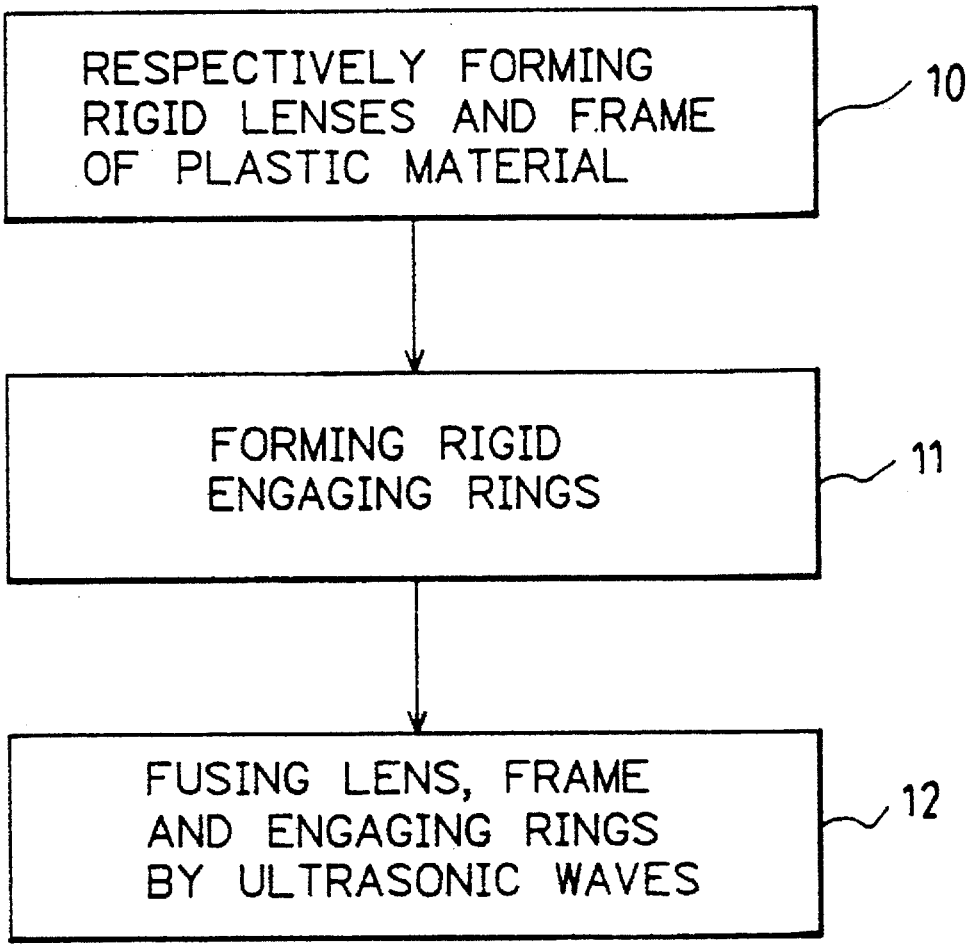
FIG. 1 is a block diagram illustrating a method for manufacturing a pair of swimming goggles in accordance with the present invention.
Figure 2:
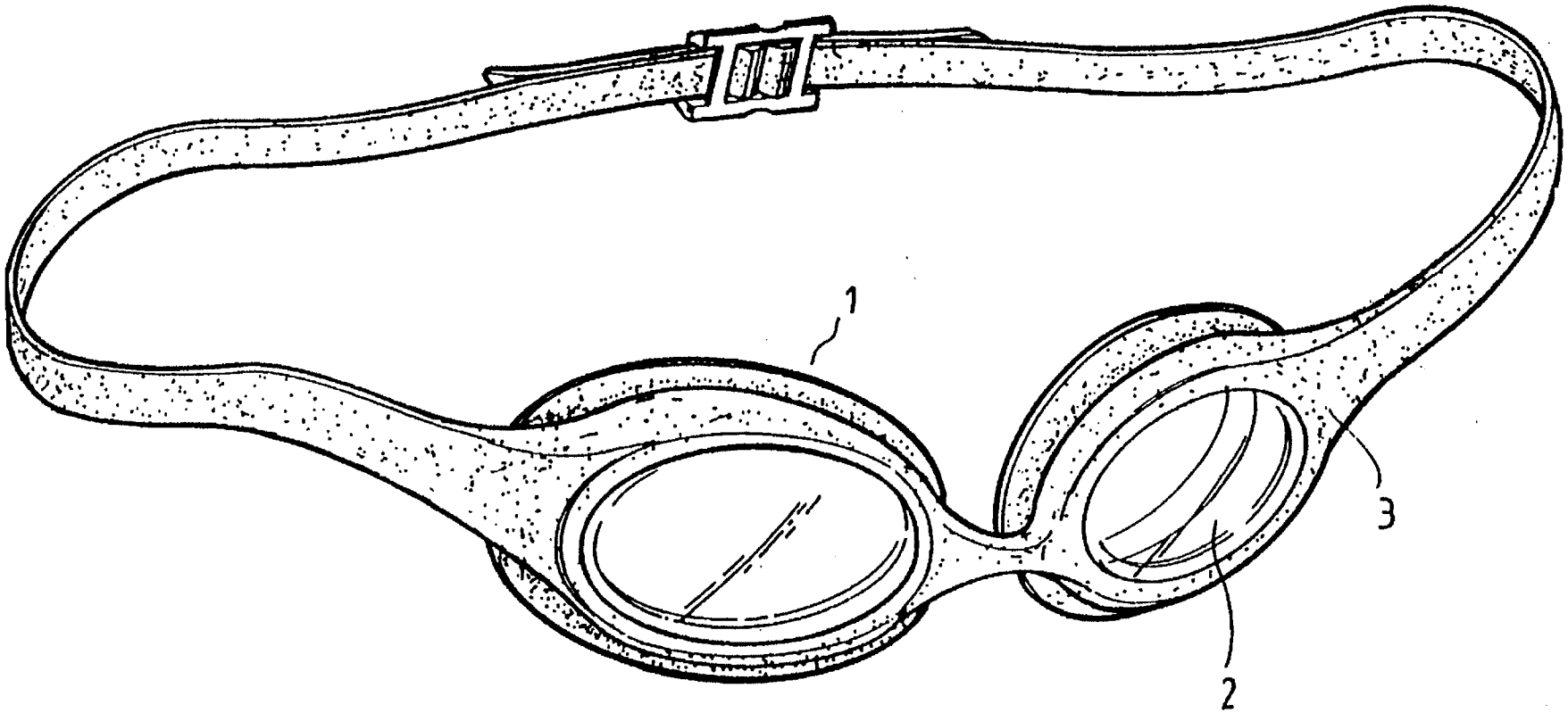
FIG. 2 is a perspective view of a pair of swimming goggles made by the method in accordance With the present invention.
Figure 3:
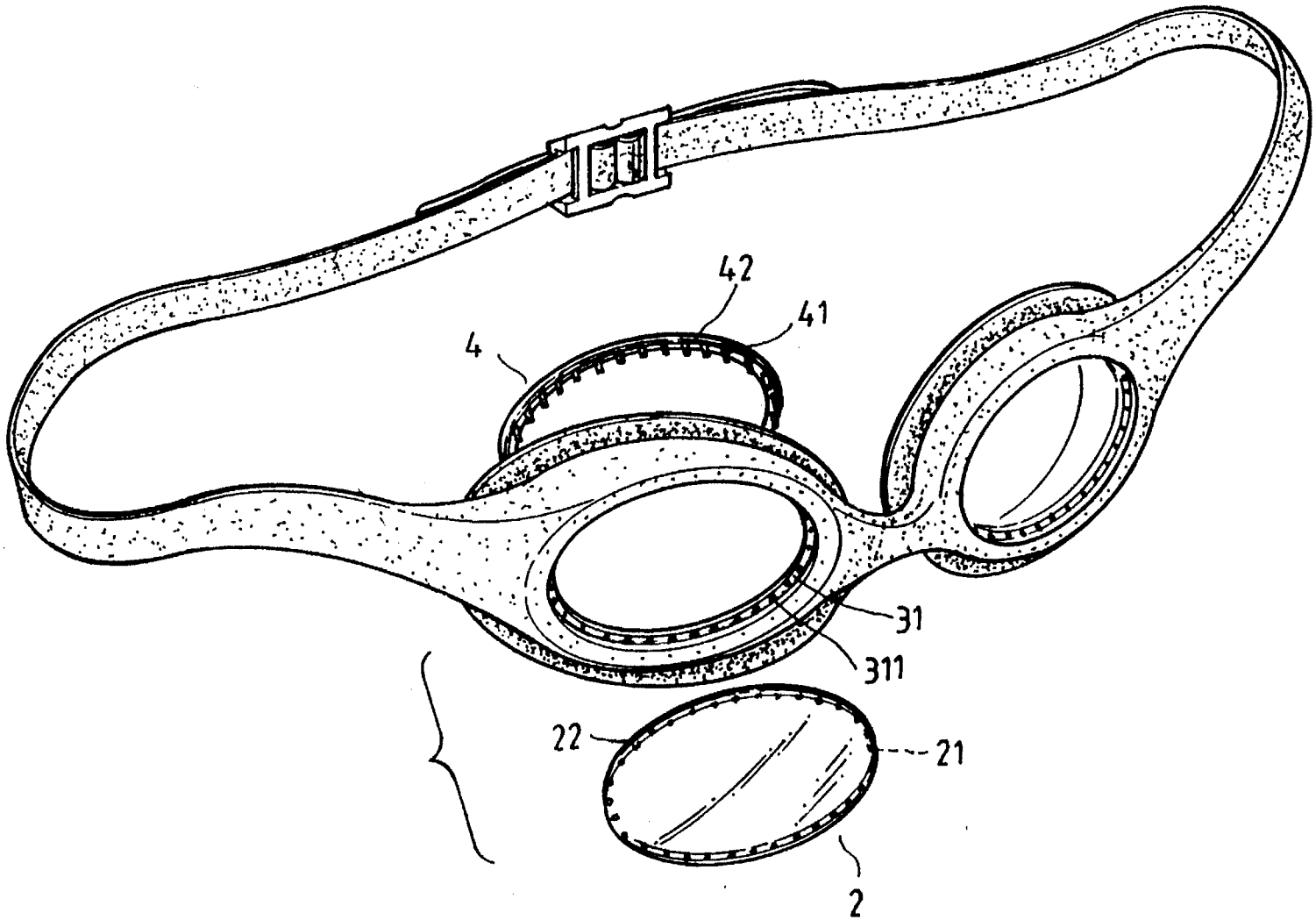
FIG. 3 is a perspective view, partly exploded, of the swimming goggles in accordance with the present invention.

Now refer to FIGS. 1 to 6 and particularly to FIGS. 1 to 3. A method for manufacturing a swimming goggles in accordance with the present invention includes the steps of: (1) respectively forming a pair of lenses 2 of rigid material and a frame 1 (see FIGS. 2 and 3) of plastic material (step 10 in FIG. 1), the frame 1 comprising a pair of rims 3 each defining an engaging groove 32 therein for respectively receiving the lenses 2 therein; (2) forming a pair of engaging rings 4 of rigid material; and (3) fusing the lenses 2, the frame 1, and the engaging rings 4 together by ultrasonic waves, thereby forming an integral pair of swimming goggles.

Figure 4:
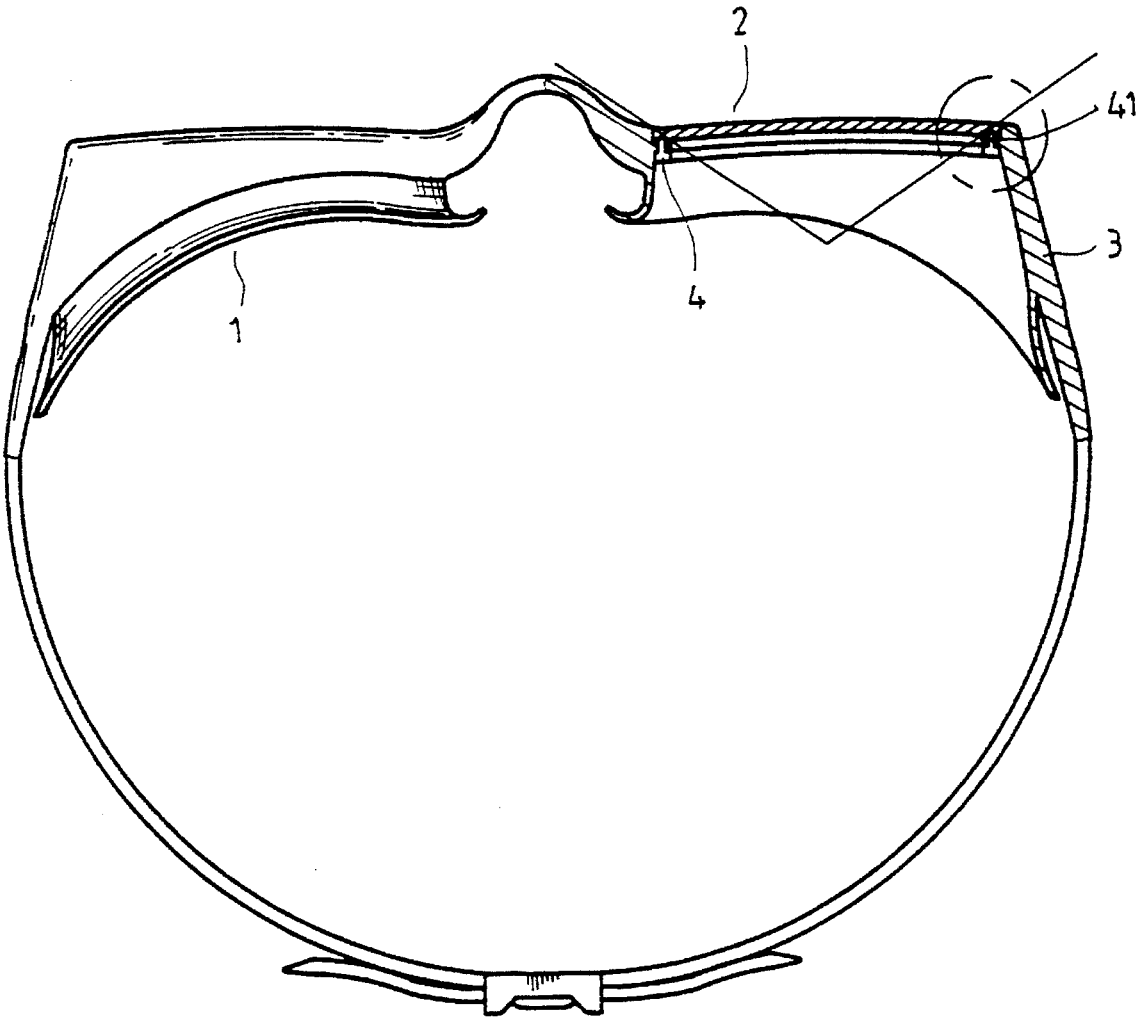
FIG. 4 is a top plan view, partly sectioned, of the swimming goggles in accordance with the present invention.
Figure 5:
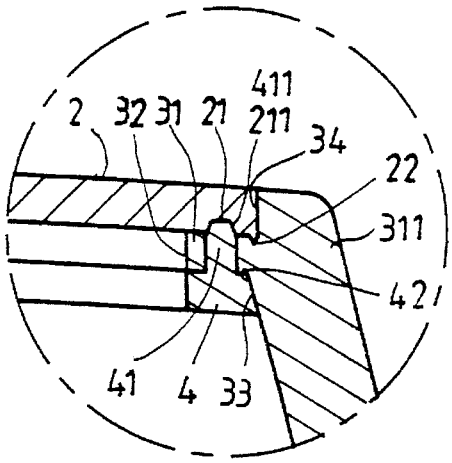
FIG. 5 is an enlarged view illustrating detailed structure in a circle in FIG. 4.

The lenses 2 are formed of rigid transparent material and include a plurality of recesses 21 defined along a periphery of a side thereof. Each engaging ring 4 includes a plurality of protrusions 41 formed along a periphery of a side thereof for engaging with an associated lens 2. Referring to FIGS. 4 and 5, a conic peripheral surface 211 defining each of the recess 21 engages with a distal end of an associated protrusion 41 having a complimentary contour. As shown in FIG. 5, each rim 3 of the frame 1 includes an annular member 31 extending inwardly from an inner periphery which defines the engaging groove 32 and thus separating the engaging groove 32 into an outer portion 34 and an inner portion 33. The annular member 31 includes a plurality of annularly disposed holes 311 through which an associated protrusion 41 of the engaging ring 4 extends to be received in the associated recess 21 of the lens 2. As best shown in FIG. 5, each lens 2 is mounted in the outer portion 34 of the associated rim 3 while the engaging ring 4 is mounted in the inner portion 33 of the rim 3 in which the protrusions 41 of the engaging ring 4 extend through the associated holes 311 of the annular member 31 to be received in the recesses 211 of the lens 2. In a preferred embodiment, as shown in FIGS. 3 and 5, each lens 2 includes a first annular ridge 22 extending along a peripheral edge of the side in which the recesses 21 are defined, while each engaging ring 4 includes a second annular ridge 42 extending along a peripheral edge of the side on which the protrusions 41 are formed. The first and second annular ridges 22 and 42 respectively and tightly bear against two sides of the annular member 31 of plastic material, thereby assuring a waterproof engagement.

Thereafter, the assembled lenses 2, rims 3, and engaging rings 4 are placed on an ultrasonic welding machine (not shown) and are then fused together by ultrasonic waves, thereby forming an integral pair of swimming goggles. Preferably, the engaging rings 4 and the lenses 2 are of the same material such that a reliable waterproof engaging effect between the protrusions 41 and the recesses 21 is provided and that the lenses 2 are reliably, fixedly received in the engaging grooves 32 of the rims 3.

It is appreciated that the side of the lens 2 which defining recesses 21 therein can also made to be flat and can be fused with the distal ends of the protrusions 41 of the engaging ring 4 by ultrasonic waves. The obtained swimming goggles still have a considerably good binding effect. It is further appreciated that the engaging ring 4 may have recesses defined therein while the lens may have protrusions formed thereon to achieve the same binding effect. In an alternative embodiment of the invention, each of the lenses includes a plurality of protrusions formed on the first side thereof, while the corresponding side of the associated engaging ring is flat. In a further alternative embodiment of the invention, the first engaging member of each lens includes an annular groove defined in the first side thereof, while the second engaging member of the associated engaging ring includes annular protrusion formed on the first side thereof.

Figure 6:
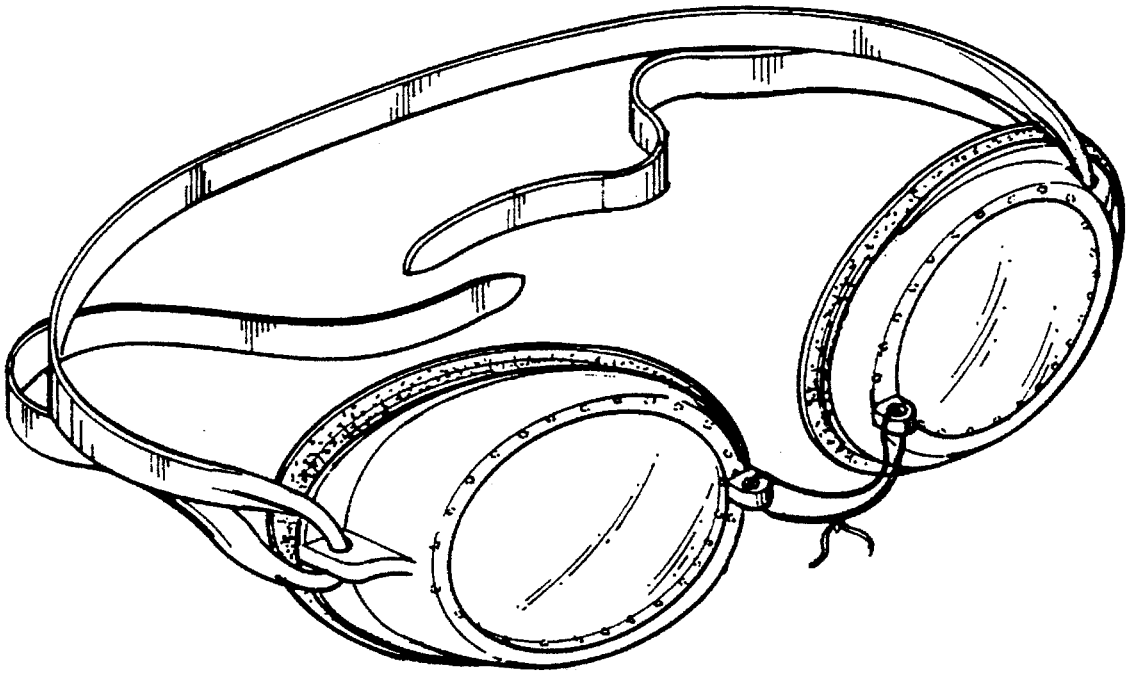
FIG. 6 is a perspective view illustrating another embodiment of the swimming goggles made by the method in accordance with the present invention.
Figure 7:
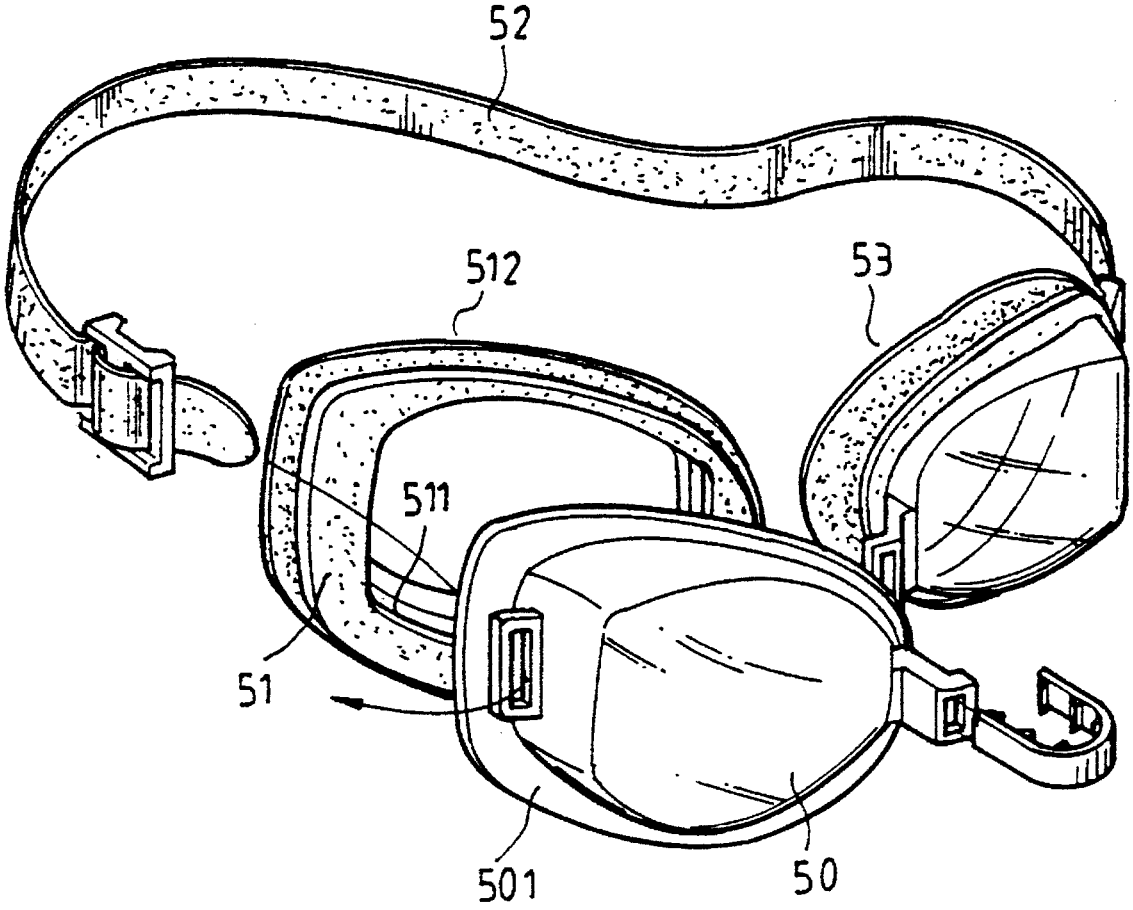
FIG . 7 PRIOR ART
FIG. 7 is a perspective view, partly exploded, of a pair of swimming goggles according to prior art.
Figure 8:
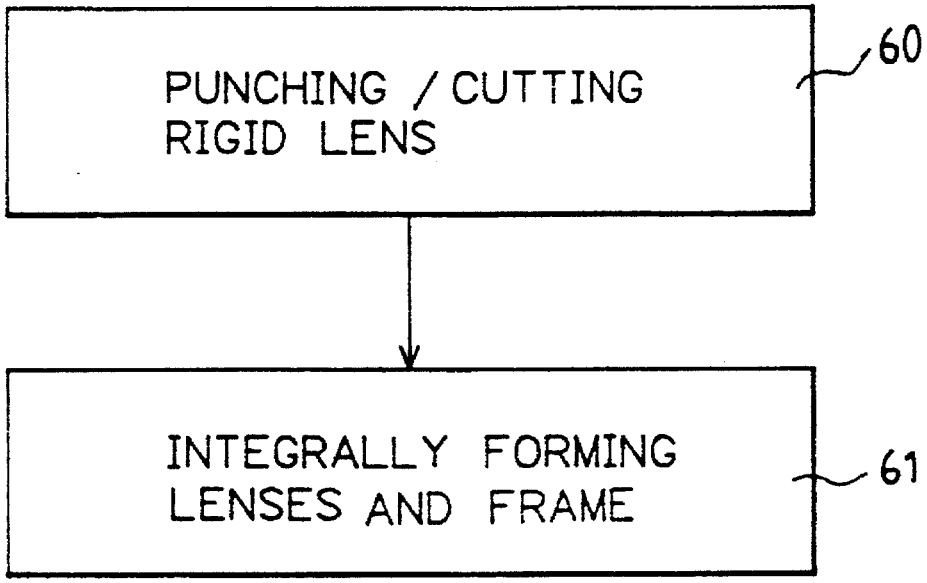
FIG. 8 PRIOR ART
FIG. 8 is a block diagram illustrating a method for manufacturing swimming goggles according to prior art.
Figure 9:
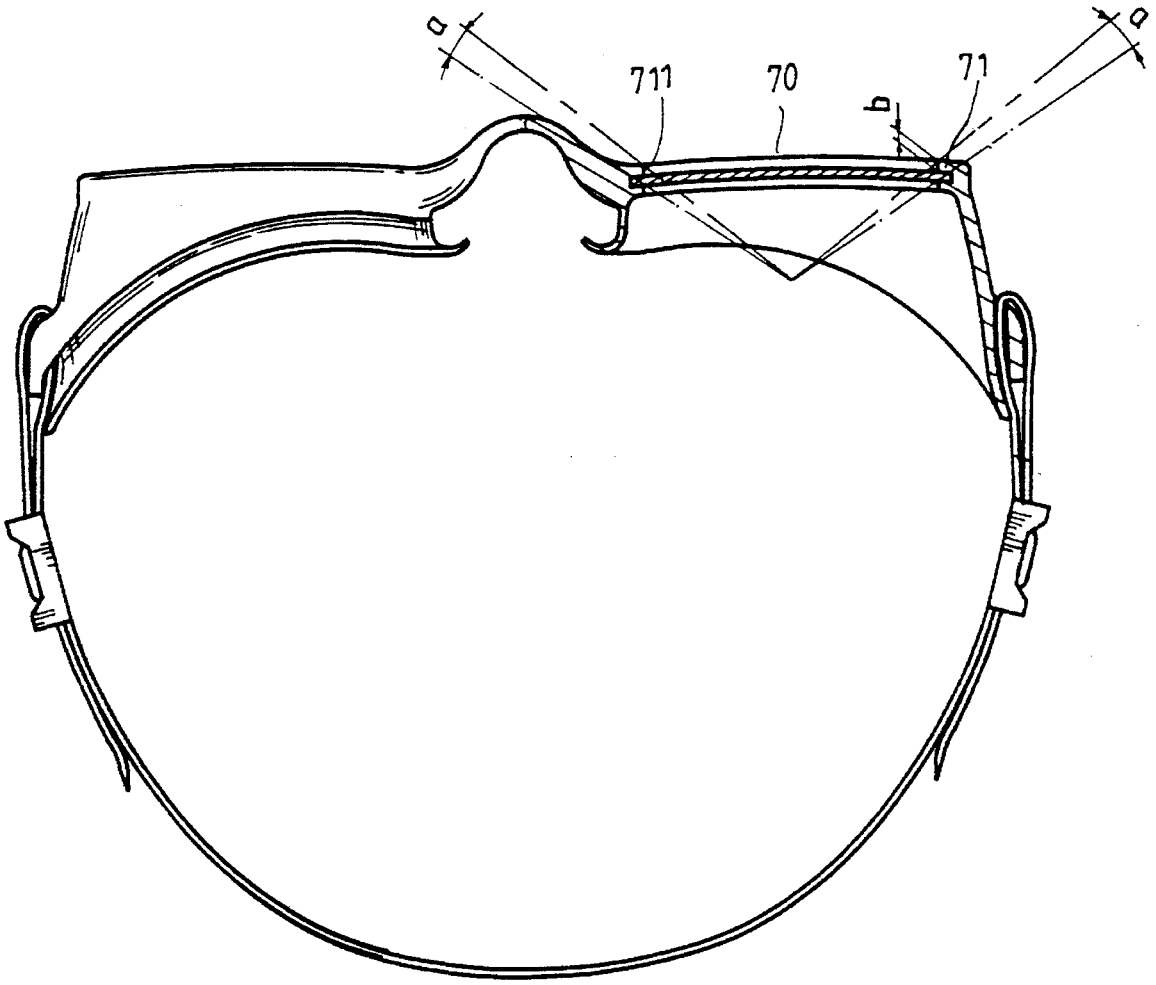
FIG . 9 PRIOR ART
FIG. 9 is a top plan view, illustrating a pair of swimming goggles made by the prior art method.

The swimming goggles shown in FIGS. 2 to 5 are for general swimmers, while a pair of swimming goggles for professional swimming athletes shown in FIG. 6 also can be made by the method in accordance with the present invention.

When compared with prior art structures, the swimming goggles made in accordance with the present invention include the following features and advantages:

(1) no lip is required on the rims 3 for engaging with the lens 2, thereby providing a larger viewing angle;

(2) the lenses 2 and the rims 3, after assembly, have a smooth outer surface, thereby providing a better water guiding effect to avoid accumulation of water which may result in restricted vision when swimming;

(3) the lenses 2 and the engaging rings 4 are of the same material, thereby providing a reliable fusion effect;

(4) the lenses 2 include recesses 21 which increase the area for ultrasonic welding;

(5) the lenses 2 and the engaging rings 4 are easily engaged together by the provisions of the conic engaging surface 211 and the complimentarily shaped distal ends of the protrusions; and (6) the first and second annular ridges 22 and 42 respectively and tightly bear against two sides of the annular member 31 of plastic material, thereby assuring the waterproof, effect.

Although the invention has been explained in relation to its preferred embodiment, it is to be understood that many other possible modifications and variations can be made without departing from the spirit and scope of the invention as hereinafter claimed.

What is claimed is:

1. A method for manufacturing a pair of swimming goggles comprising the steps of:

(a) respectively forming a pair of lenses of a transparent first rigid material and a frame of plastic material, the frame comprising a pair of rims each defining an engaging groove therein, each of the rims comprising an annular member extending inwardly from an inner periphery which defines the engaging groove and thus separating the engaging groove into an outer portion for receiving the lens and an inner portion, each of the lenses having a first engaging member formed on a first side thereof;

(b) forming a pair of engaging rings of rigid material, each of the engaging rings having a second engaging member on a first side thereof and being mounted in the inner portion of the associated rim, wherein one of each of the first engaging members and the second engaging members extends through the associated annular member to engage with one another; and (c) fusing the lenses, the frame, and the engaging rings together by ultrasonic waves, thereby forming an integral pair of swimming goggles.

2. The method as claimed in claim 1, wherein the first engaging member of each of the lenses includes a plurality of recesses defined along a periphery of the first side thereof, and the second engaging member of each of the engaging rings includes a plurality of protrusions formed along a periphery of the first side thereof, and the annular member includes a plurality of annularly disposed holes through which an associated said protrusion of the engaging ring extends to be received in the associated recess of the lens.

3. The method as claimed in claim 2, wherein each of the protrusions has a distal end for engaging with a conic peripheral surface which defines each of the recesses.

4. The method as claimed in claim 1, wherein the first engaging member of each of the lenses includes a plurality of protrusions defined along a periphery of the first side thereof, and the second engaging member of each of the engaging rings includes a plurality of recesses formed along a periphery of the first side thereof, and the annular member includes a plurality of annularly disposed holes through which an associated said protrusion of the lens extends to be received in the associated recess of the engaging ring.

5. The method as claimed in claim 4, wherein each of the protrusions has a distal end for engaging with a conic peripheral surface which defines each of the recesses.

6. The method as claimed in claim 1, wherein each of the lenses includes a first annular ridge extending along a peripheral edge of the first side thereof and each of the engaging rings includes a second annular ridge extending along a peripheral edge of the first side thereof, the first and second annular ridges respectively and tightly bearing against two sides of the annular member.

7. The method as claimed in claim 1, wherein the first engaging member of the lens includes a plurality of protrusions formed on the first side thereof, while the first side of the engaging ring is flat.

8. The method as claimed in claim 1, wherein the first engaging member of the lens includes an annular groove defined in the first side thereof, while the second engaging member of the engaging ring includes annular protrusion formed on the first side thereof.

9. A pair of swimming goggles comprising:

a frame of plastic material and comprising a pair of rims each defining an engaging groove therein, each of the rims comprising an annular member extending inwardly from an inner periphery which defines the engaging groove and thus separating the engaging groove into an outer portion and an inner portion;

a pair of lenses of a transparent first rigid material and each being received in the outer portion of the associated rim and having a first engaging member formed on a first side thereof;

a pair of engaging rings of rigid material and each having a second engaging member on a first side thereof and being mounted in the inner portion of the associated rim, one of each of the first engaging members and the second engaging members extending through the associated annular member to engage with one another; and the lenses, the frame, and the engaging rings being joined together by ultrasonic waves, thereby forming an integral pair of swimming goggles.

10. The swimming goggles as claimed in claim 9, wherein the first engaging member of each of the lenses includes a plurality of recesses defined along a periphery of the first side thereof, and the second engaging member of each of the engaging rings includes a plurality of protrusions formed along a periphery of the first side thereof, and the annular member includes a plurality of annularly disposed holes through which an associated said protrusion of the engaging ring extends to be received in the associated recess of the lens.

11. The swimming goggles as claimed in claim 10, wherein each of the protrusions has a distal end for engaging with a conic peripheral surface which defines each of the recesses.

12. The swimming goggles as claimed in claim 9, wherein the first engaging member of each of the lenses includes a plurality of protrusions defined along a periphery of the first side thereof, and the second engaging member of each of the engaging rings includes a plurality of recesses formed along a periphery of the first side thereof, and the annular member includes a plurality of annularly disposed holes through which an associated said protrusion of the lens extends to be received in the associated recess of the engaging ring.

13. The swimming goggles as claimed in claim 12, wherein each of the protrusions has a distal end for engaging with a conic peripheral surface which defines each of the recesses.

14. The swimming goggles as claimed in claim 9, wherein each of the lenses includes a first annular ridge extending along a peripheral edge of the first side thereof and each of the engaging rings includes a second annular ridge extending along a peripheral edge of the first side thereof, the first and second annular ridges respectively and tightly bearing against two sides of the annular member.

15. The swimming goggles as claimed in claim 9, wherein the first engaging member of the lens includes a plurality of protrusions formed on the first side thereof, while the first side of the engaging ring is flat.

16. The swimming goggles as claimed in claim 9, wherein the first engaging member of the lens includes an annular groove defined in the first side thereof, while the second engaging member of the engaging ring includes annular protrusion formed on the first side thereof.

* * * * *